US010994887B2

(12) United States Patent
Polloni et al.

(10) Patent No.: US 10,994,887 B2
(45) Date of Patent: May 4, 2021

(54) RIGID PACKAGE FOR SMOKING ARTICLES

(71) Applicant: G.D SOCIETA' PER AZIONI, Bologna (IT)

(72) Inventors: Roberto Polloni, Modigliana (IT); Marcello Tenaglia, Bologna (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 16/481,598

(22) PCT Filed: Feb. 9, 2018

(86) PCT No.: PCT/IB2018/050816
§ 371 (c)(1),
(2) Date: Jul. 29, 2019

(87) PCT Pub. No.: WO2018/146631
PCT Pub. Date: Aug. 16, 2018

(65) Prior Publication Data

US 2019/0352041 A1 Nov. 21, 2019

(30) Foreign Application Priority Data

Feb. 10, 2017 (IT) ..... 102017000015155

(51) Int. Cl.
*B65D 5/02* (2006.01)
*B65B 19/22* (2006.01)
(Continued)

(52) U.S. Cl.
CPC ..... *B65D 5/0227* (2013.01); *B65B 19/22* (2013.01); *B65D 5/66* (2013.01); *B65D 75/5894* (2013.01);
(Continued)

(58) Field of Classification Search
CPC ..... B65B 19/22; B65D 5/02; B65D 5/0227; B65D 5/66; B65D 75/58; B65D 75/5894;
(Continued)

(56) References Cited

U.S. PATENT DOCUMENTS 4,526,317 A 7/1985 Cassidy
7,455,177 B2 11/2008 Serafini et al.
(Continued)

FOREIGN PATENT DOCUMENTS

EP 2361839 A1 8/2011
EP 2366637 A1 9/2011
(Continued)

OTHER PUBLICATIONS

International Application No. PCT/IB2018/050816, International Search Report and Written Opinion, dated Jul. 6, 2018.

*Primary Examiner* — Bryon P Gehman
(74) *Attorney, Agent, or Firm* — Marshall, Gerstein & Borun LLP

(57) ABSTRACT

Package for smoking articles having: a group of smoking articles; an outer container having an open top end; a lid hinged to the outer container to close the open top end; a collar which is glued on the inside of the outer container so as to partially project outwards from the open top end and has a through pull-out opening, through which the smoking articles can be pulled out; and a sealing flap, which is glued to the collar, is arranged on the outside of the collar and on top of the collar itself, covers, at least when the lid is in the closed position, the pull-out opening, and is provided with a connecting tab which is permanently and non-removably glued to a front wall of the lid by means of a permanent glue so that the opening and closing of the lid also simultaneously opens and closes the pull-out opening.

11 Claims, 17 Drawing Sheets

(51) Int. Cl.
*B65D 5/66* (2006.01)
*B65D 75/58* (2006.01)
*B65D 85/10* (2006.01)

(52) U.S. Cl.
CPC .... *B65D 85/1045* (2013.01); *B65D 2575/586* (2013.01)

(58) Field of Classification Search
CPC .... B65D 85/10; B65D 85/1045; B65D 85/12; B65D 2575/586
USPC ..... 206/264, 268
See application file for complete search history.

(56) References Cited

U.S. PATENT DOCUMENTS 8,091,703 B2 * 1/2012 Marchetti ..... B65D 85/1045 206/268
8,590,701 B2 * 11/2013 Bertuzzi ..... B65D 85/1045 206/268
9,089,165 B2 * 7/2015 Bertuzzi ..... B65D 85/1045
10,427,864 B2 * 10/2019 Polloni ..... B65D 85/1045
2011/0114518 A1 5/2011 Hein

FOREIGN PATENT DOCUMENTS

WO WO-99/28212 A1 6/1999
WO WO-02/079051 A1 10/2002
WO WO-2008/087378 A1 7/2008
WO WO-2008/142540 A1 11/2008
WO WO-2010/003697 A1 1/2010
WO WO-2012/147073 A1 11/2012
WO WO-2013/098109 A1 7/2013
WO WO-2015/040059 A1 3/2015
WO WO-2016/035046 A1 3/2016
WO WO-2016/059366 A1 4/2016
WO WO-2016/087828 A1 6/2016

* cited by examiner

RIGID PACKAGE FOR SMOKING ARTICLES

CROSS-REFERENCE TO RELATED APPLICATIONS

This is the U.S. national phase of International Application No. 2018/050816 PCT/IB2018/050816, filed Feb. 9, 2018, which claims the benefit of Italian Application No. 102017000015155, filed Feb. 10, 2017.

TECHNICAL FIELD

The present invention relates to a rigid package for smoking articles.

The present invention finds advantageous application to a cigarette package, to which the following description will make explicit reference without thereby losing generality.

PRIOR ART

The rigid cigarette packages with hinged lids are the most widely used cigarette packages on the market as they are simple to implement, easy and practical to use, and offer good protection to the cigarettes contained inside thereof.

A rigid cigarette package with a hinged lid comprises an inner wrap formed by a group of cigarettes wrapped in a sheet of metallized paper and a rigid outer casing which houses the inner wrap; the inner wrap is initially completely closed and has a tear-off top portion (called "pull") which is removed when the cigarette package is opened for the first time so as to allow the pull-out of the cigarettes contained inside the inner wrap. The outer casing is formed by a cup-shaped container having an open top end, and a lid, which is also cup-shaped and is hinged to the container so as to rotate, relative to the container, between an open position and a closed position of the open end.

In the rigid cigarette package with hinged lid described in patent applications WO2008142540A1 and WO2012147073A1, the inner wrap is impermeable and has a cigarette pull-out opening, which is closed by a re-stick sealing flap; in other words, the sealing flap is provided with a non-dry re-stick adhesive which allows the sealing flap to be secured several times in a closed position closing the cigarette pull-out opening. To simplify the opening and closing of the cigarette package, i.e. to allow the lid of the outer casing and the sealing flap of the inner wrap to be opened and closed together in a single operation, a portion of the sealing flap is permanently and non-removably glued to an inner surface of a front wall of the lid so that the opening or closing of the lid also simultaneously opens and closes the sealing flap.

However, in the rigid cigarette package with hinged lid disclosed in patent applications WO2008142540A1 and WO2012147073A1 it has been observed that the lid tends not to remain in the fully closed position, but tends spontaneously to open and thus being arranged in a semi-open position which is unappreciated by consumers as it conveys a feeling of malfunction.

To try to solve this problem, it has been proposed to provide the cigarette package with a collar which embraces the inner wrap, is glued on the inside of the container, protruding from the open top end of the container and has a front wall provided with a pair of claw-shaped elements laterally projecting to engage the lid with interference when the lid is in the closed position so as to hold the lid with greater force in the closed position. However, the presence of the collar has some drawbacks, since the presence of the collar causes an increase in the wrapping material necessary to make the cigarette package and above all the collar can interfere with the sealing flap glued to the lid, thus obliging to reduce the dimensions of the sealing flap (and consequently decreasing the size of the cigarette pull-out opening and therefore making the pull-out of the cigarettes more difficult).

Patent application EP2361839A1 describes a rigid cigarette package provided with a collar comprising: a front wall, a top wall, a back wall, and side walls opposite to one another; in the collar and at the front wall and of the top wall a cigarette pull-out opening is obtained, closed by a re-stick sealing flap Patent application EP2366637 describes a rigid package having: a group of cigarettes; an inner package enclosing the group of cigarettes and having an extraction opening; a reclosable sealing panel, which closes the extraction opening of the inner package, and has an inner surface gummed with non-dry, re-stick adhesive, and a grip tab with no re-stick adhesive; and a rigid outer container, which houses the inner package, and has an open end, and a lid hinged to rotate between an open position and a closed position opening and closing the open end respectively.

Patent application WO2016059366A1 describes a cigarette pack comprising a base having front and a rear faces. The base contains a group of cigarettes wrapped in a barrier layer to form a bundle, and a lid is pivotably attached to the rear face of the base for movement between open and closed positions. The barrier layer has a front wall and a region that defines an extraction opening for the removal of tobacco industry products from the bundle. A flexible label extends over said region and has a peripheral section extending beyond an edge of said region over a portion of the barrier layer surrounding said region. The peripheral section releasably adheres to the barrier layer to close said extraction opening.

Patent application WO2016035046A1 describes a reclosable package of cigarettes, comprising: a group of cigarettes; a soft envelope provided with a cigarette extraction opening; a stiffening element wrapping the envelope along at least two opposite surfaces of the envelope and at the extraction opening; and a reclosable opening system consisting in an adhesive closing panel superimposed in a removable manner on an adhesive frame panel.

DESCRIPTION OF THE INVENTION

The object of the present invention is to provide a rigid package for smoking articles with a hinged lid, which package is free from the drawbacks described above and is, at the same time, easy and inexpensive to manufacture.

According to the present invention, a rigid package for smoking articles with a hinged lid is provided, as claimed in the appended claims.

BRIEF DESCRIPTION OF THE DRAWINGS

The present invention will now be described with reference to the attached drawings, which illustrate some non-limiting embodiments thereof, wherein.

PREFERRED EMBODIMENTS OF THE INVENTION

Figure 2:
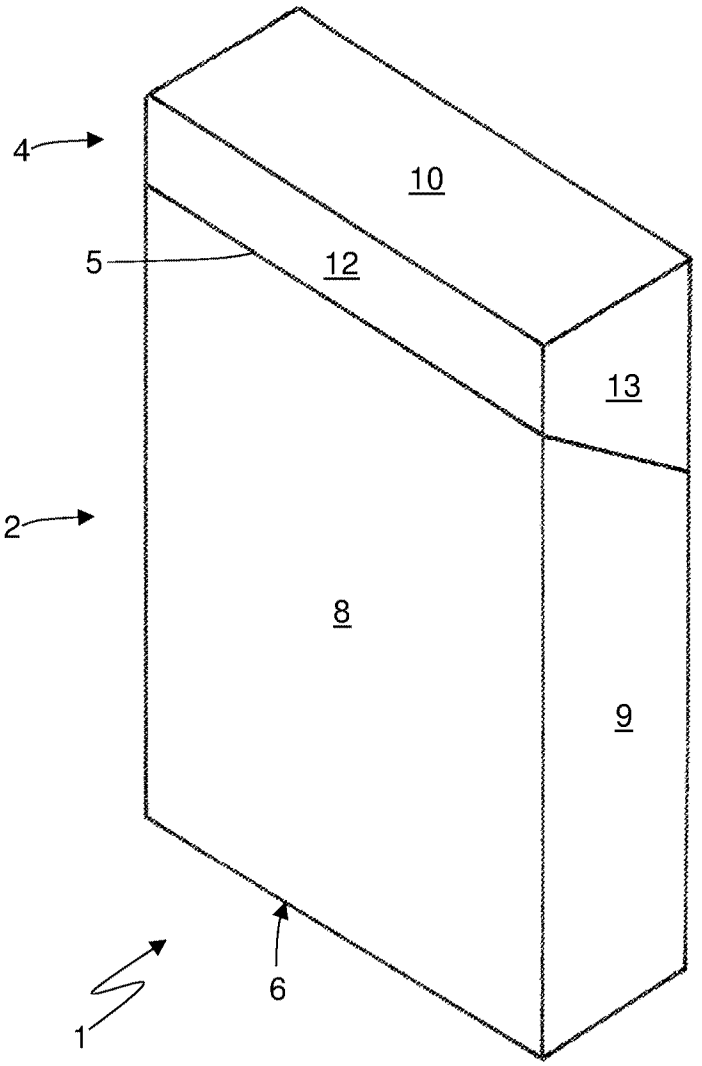
FIG. 2 is a rear perspective view of the cigarette package of FIG. 1 in a closed configuration.
Figure 1:
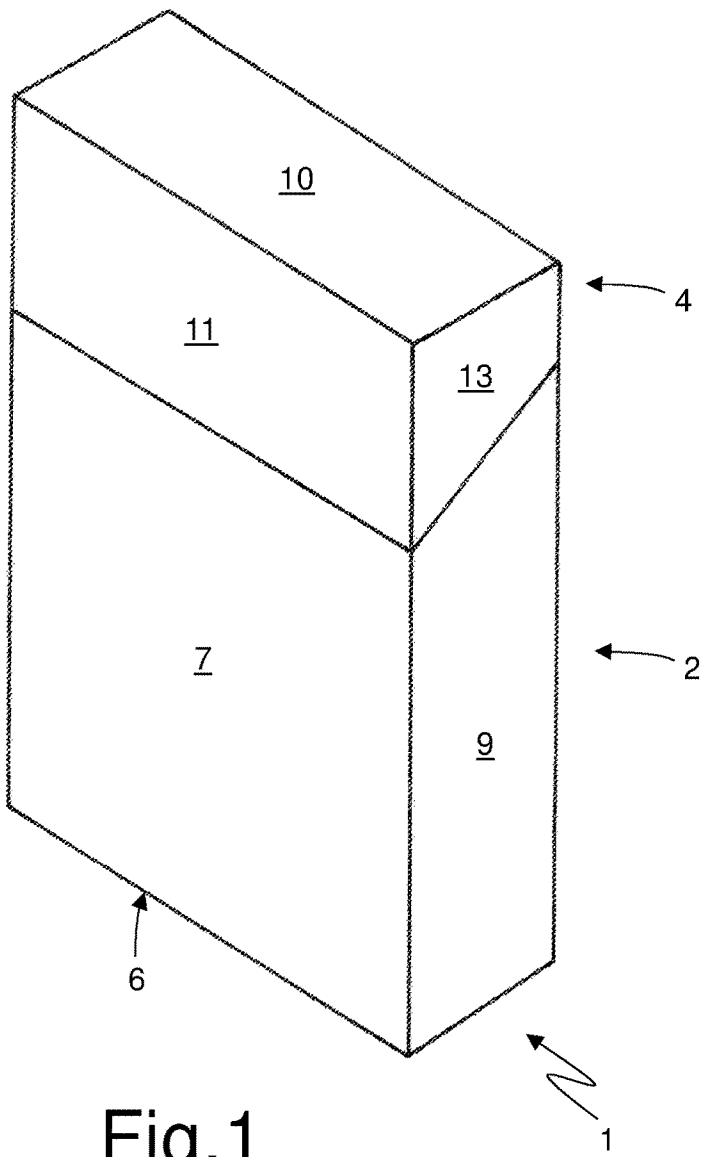
FIG. 1 is a front perspective view and in a closed configuration of a cigarette package made according to the present invention.
Figure 3:
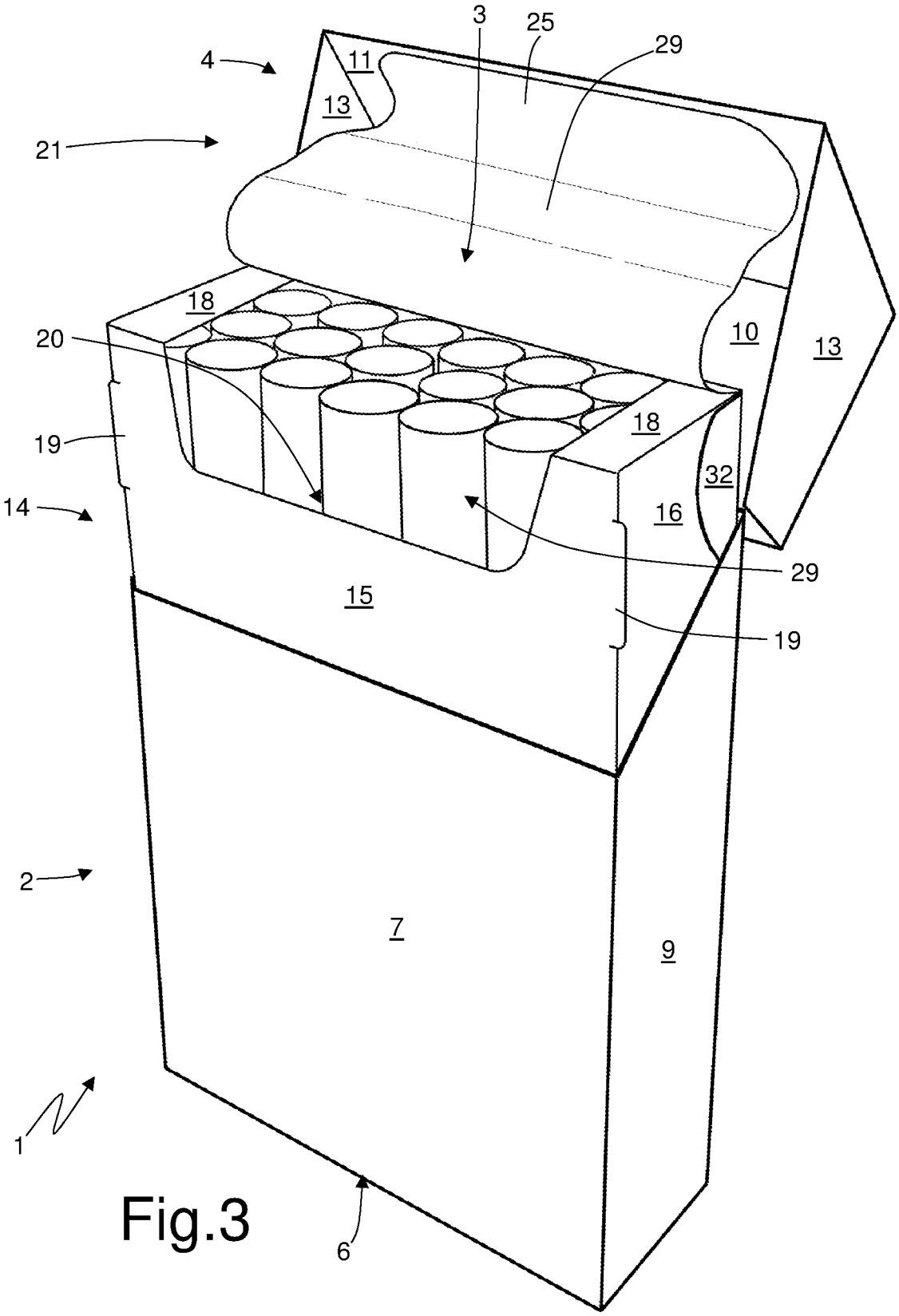
FIG. 3 is a front perspective view of the cigarette package of FIG. 1 in an open configuration.

In FIGS. 1, 2 and 3 number 1 denotes as a whole a rigid cigarette package. The cigarette package 1 comprises an outer container 2 formed by a rigid and cup-shaped cardboard or paperboard.

The outer container 2 has an open top end 3 and is provided with a lid 4, which is cup-shaped and is hinged to the outer container 2 along a hinge 5 (illustrated in FIG. 2) so as to rotate, relative to the outer container 2, between an open position (illustrated in FIG. 3) and a closed position (illustrated in FIGS. 1 and 2) of the open top end 3. The outer container 2 has a substantially parallelepiped rectangular shape oriented according to a prevailing development direction, is cup-shaped, and has the open top end 3, a bottom wall 6 opposite the open top end 3, a front wall 7 and a rear wall 8 (in which the hinge 5 is formed), which are parallel and opposite to one another, and two side walls 9 parallel and opposite to one another. Between the front wall 7, rear wall 8 and side walls 9 of the outer container 2, four longitudinal edges are defined, whereas between the walls 7, 8 and 9 and the bottom wall 6 of the outer container 2, four transverse edges are defined.

The lid 4 has a substantially rectangular parallelepiped shape, is cup-shaped, and has an open bottom end (facing the open top end 3 of the outer container 2 when the lid 4 is in the closed position), a top wall 10 (which is parallel and opposite to the bottom wall 6 of the outer container 2 when the lid 4 is in the closed position), a front wall 11 (which is parallel and aligned with the front wall 7 of the outer container 2 when the lid 4 is in the closed position) a rear wall 12 (which is parallel and aligned with the rear wall 8 of the outer container 2 when the lid 4 is in the closed position and is hinged to the rear wall 8 of the outer container 2 along the hinge 5), and two side walls 13 parallel and opposite to one another (which are parallel and aligned, in particular coplanar and adjacent, to the side walls 9 of the outer container 2 when the lid 4 is in the closed position). Between the front wall 11, the rear wall 12 and the side walls 13 of the lid 4, four longitudinal edges are defined, whereas between the walls 11, 12 and 13 and the top wall 10 of the lid 4, four transverse edges are defined. The longitudinal edges and the transverse edges of the lid 4 are parallel and aligned with the corresponding longitudinal and transverse edges of the outer container 2 when the lid 4 is in the closed position.

Figure 7:
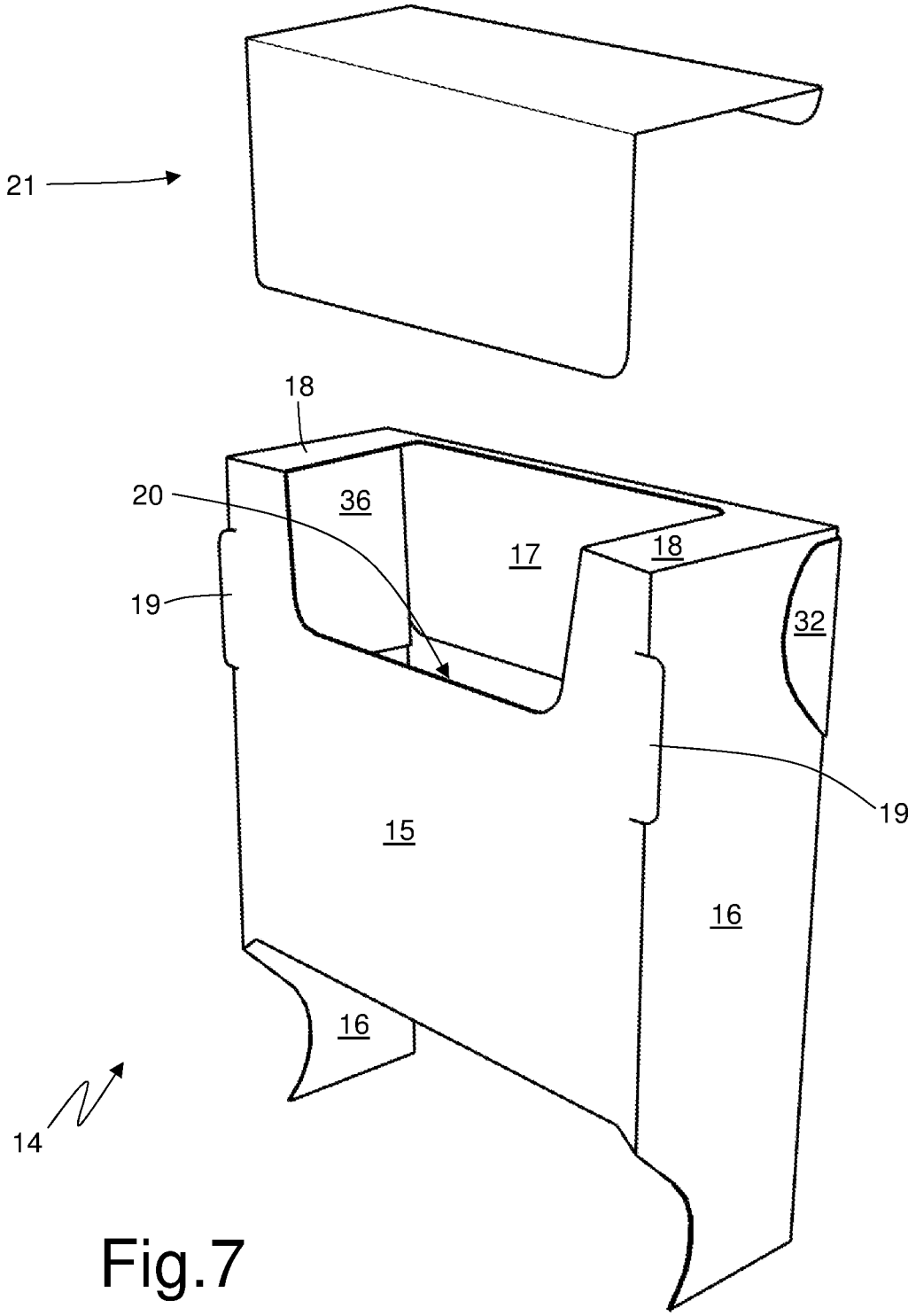
FIG. 7 is a front and exploded perspective view of a collar of the package of FIG. 1.

As illustrated in FIGS. 3 and 7, the cigarette package 1 comprises a collar 14, which is fixed (normally by gluing) on the inside of the outer container 2 so as to partially project outwards from the open top end 3 and engage a corresponding inner surface of the lid 4 when the lid 4 is arranged in said closed position. The collar 14 comprises a front wall 15 which overlaps and is glued to the front wall 7 of the container 2, two side walls 16 which are folded by 90° relative to the front wall 15 and overlap and are glued to the side walls 9 of the container 2, a rear wall 17 which is folded by 90° relative to the side walls 16, is parallel to the front wall 15 and is glued to the rear wall 8 of the container 2, and a top wall 18 which is perpendicular to the walls 15, 16 and 17. The rear wall 17 of the collar 14 is perpendicular to the top wall 18 and to the side walls 16, is parallel and opposite to the front wall 15, and overlaps and is glued to the rear wall 8 of the container 2; moreover, the rear wall 17 of the collar 14 is parallel and facing (and substantially in contact with) the rear wall 12 of the lid 4 when the lid 4 is in the closed position (illustrated in FIGS. 1 and 2). The top wall 18 of the collar 14 is arranged perpendicular to the front wall 15, to the side walls 16 and to the rear wall 17 and is parallel and facing (and substantially in contact with) the top wall 10 of the lid 4 when the lid 4 is in the closed position (illustrated in FIGS. 1 and 2).

The collar 14 has the function of holding the lid 4 in the closed position with a given force so as to avoid undesired openings of the lid 4; this "blocking" function of the lid 4 in the closed position is carried out by virtue of the fact that when the lid 4 is in the closed position the inner collar 14 partially projects from the open end of the container 2 and therefore engages a corresponding inner surface of the lid 4: in this way, to open the lid 4 it is necessary to elastically and slightly deform the lid 4 and/or the collar 14 and therefore it is necessary to apply a given force to the lid 4 to open the lid 4 itself. According to the embodiments illustrated in the accompanying figures, the front wall 15 of the collar 14 is provided with a pair of claw-shaped elements 19 which laterally project to engage the lid 4 with interference when the lid 4 is in the closed position so as to hold with greater force the lid 4 in the closed position. According to a different embodiment not illustrated, the front wall 15 of the collar 14 is free from the claw-shaped elements 19.

The collar 14 has a pull-out opening 20 which is centrally arranged and involves a portion of the front wall 15 of the collar 14 and a portion of the top wall 18 of the collar 14. The pull-out opening 20 is formed by making a close-shaped through incision, through the collar 14 which delimits on the inside thereof a disposable portion of the collar 14 that is eliminated so as to leave a hole (forming the pull-out opening 20). In the embodiment illustrated in the accompanying figures, the pull-out opening 20 does not involves the entire depth of the top wall 18 of the collar 14 and therefore the top wall 18 of the collar 14 is physically present on both opposite sides of the pull-out opening 20, and behind the pull-out opening 20 (i.e. the top wall 18 of the collar 14 is "U" shaped and surrounds the pull-out opening 20 from three sides); according to a different embodiment not illustrated, the pull-out opening 20 involves the entire depth of the top wall 18 of the collar 14 and therefore the top wall 18 of the collar 14 is physically present only on the two opposite sides of the pull-out opening 20.

Figure 8:
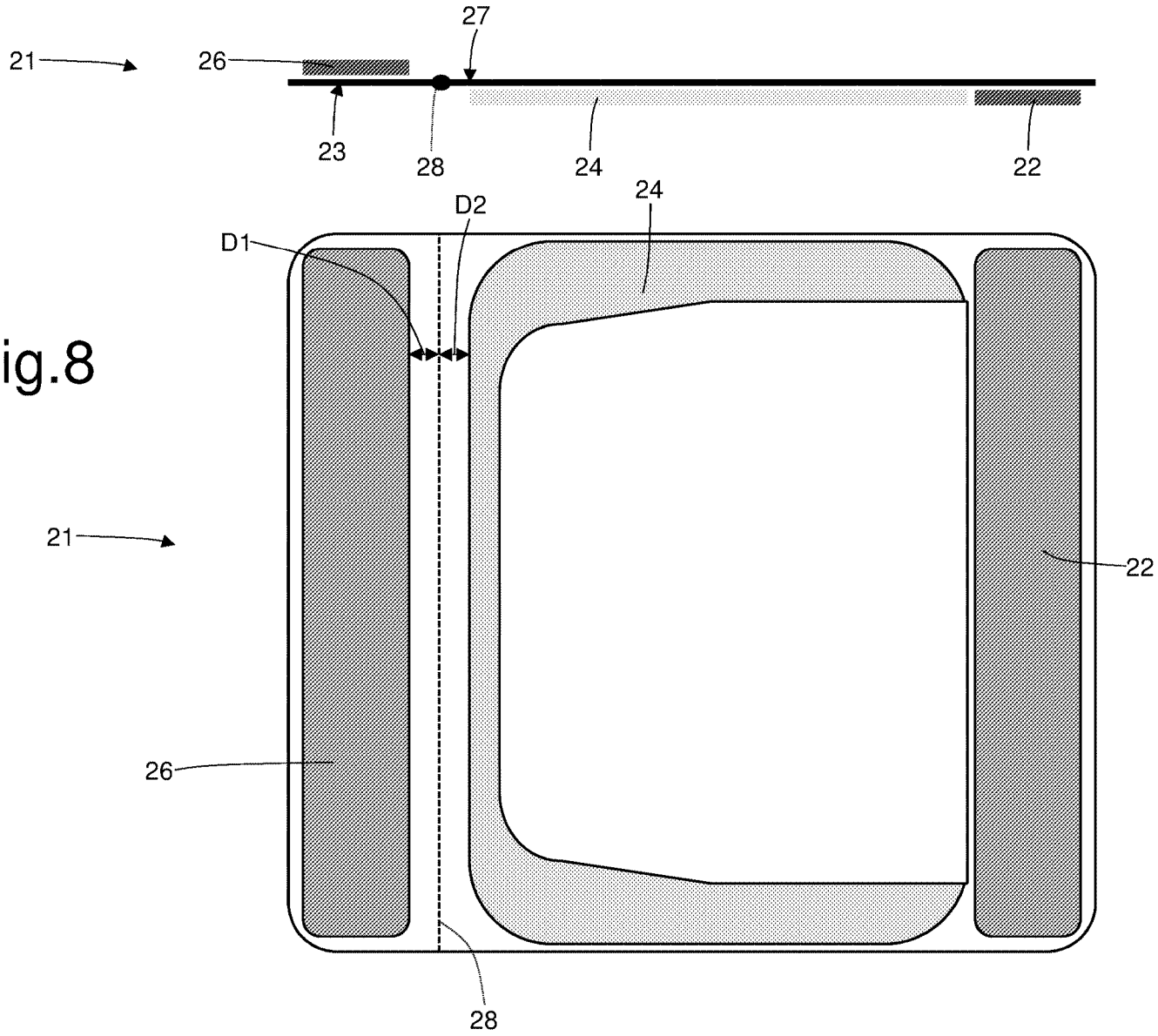
FIG. 8 is a plan and side view of an adhesive sealing flap coupled to the blank of FIG. 7.

As illustrated in FIGS. 7 and 8, the pull-out opening 20 of the collar 14 is normally closed by a re-stick sealing flap 21 which is fixed to the collar 14 by means of the permanent glue (illustrated in FIG. 8), which is applied to the inner surface 23 of the sealing flap 21 (i.e. the surface of the sealing flap 21 facing towards the collar 14) and is arranged partly at the top wall 18 of the collar 14 and partly at the rear wall 17 of the collar 14. In the embodiment illustrated in the accompanying figures, the top wall 18 of the collar 14 is "U"-shaped and surrounds the pull-out opening 20 by means of two side portions and a rear section (i.e. the top wall 18 of the collar 14 surrounds the pull-out opening 20 laterally and in the rear part); preferably, the permanent glue 22 is placed only on a rear section of the top wall 18 of the collar 14.

Thanks to the presence of the permanent glue 22 (i.e. a glue that dries after its application forming a strong and non-separable bond, if not through a violent and destructive tear), the sealing flap 21 always remains coupled to the collar 14, i.e. it never completely separates (except as a result of a violent and destructive tear) from the collar 14.

According to a preferred but non-binding embodiment, the sealing flap 21 is fixed to the collar 14 also by means of the re-stick glue 24 (illustrated in FIG. 8) which is placed around the pull-out opening 20 so as to allow the sealing flap 21 to be repeatedly (that is, each time the cigarette package 1 is opened) partially separated from the collar 14 and then again fixed to the collar 14 (each time the cigarette package 1 is closed). In other words, the re-stick glue 24 is a glue that does not dry after its application and therefore allows the separation and subsequent re-adhesion of the sealing flap 21 to the underlying collar 14 several times.

Figure 4:
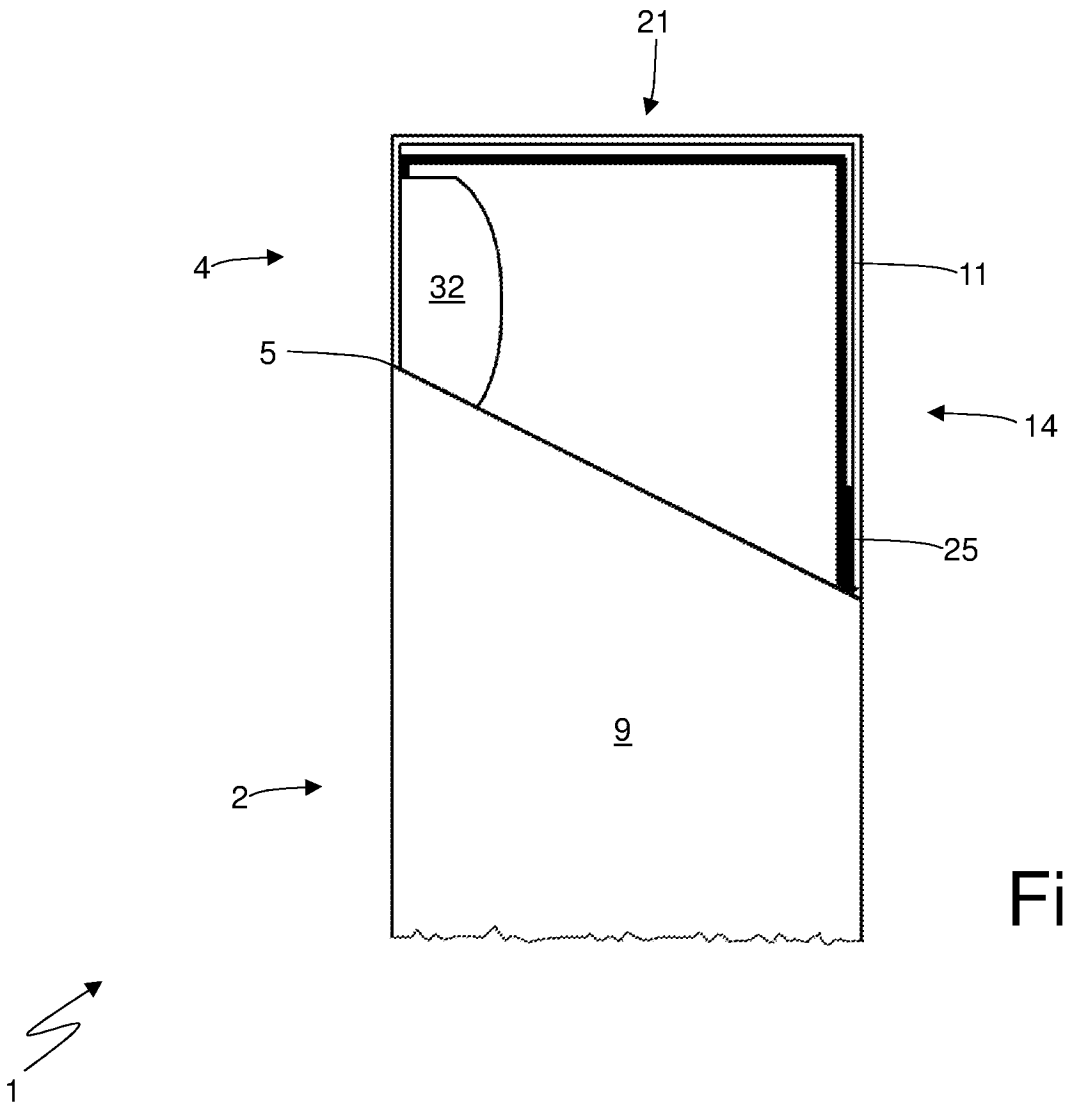
FIGS. 4, 5 and 6 are three schematic side views with parts removed for clarity of a lid of the package of FIG. 1 in a closed position, in a partially open position, and in a completely open position, respectively.
Figure 5:
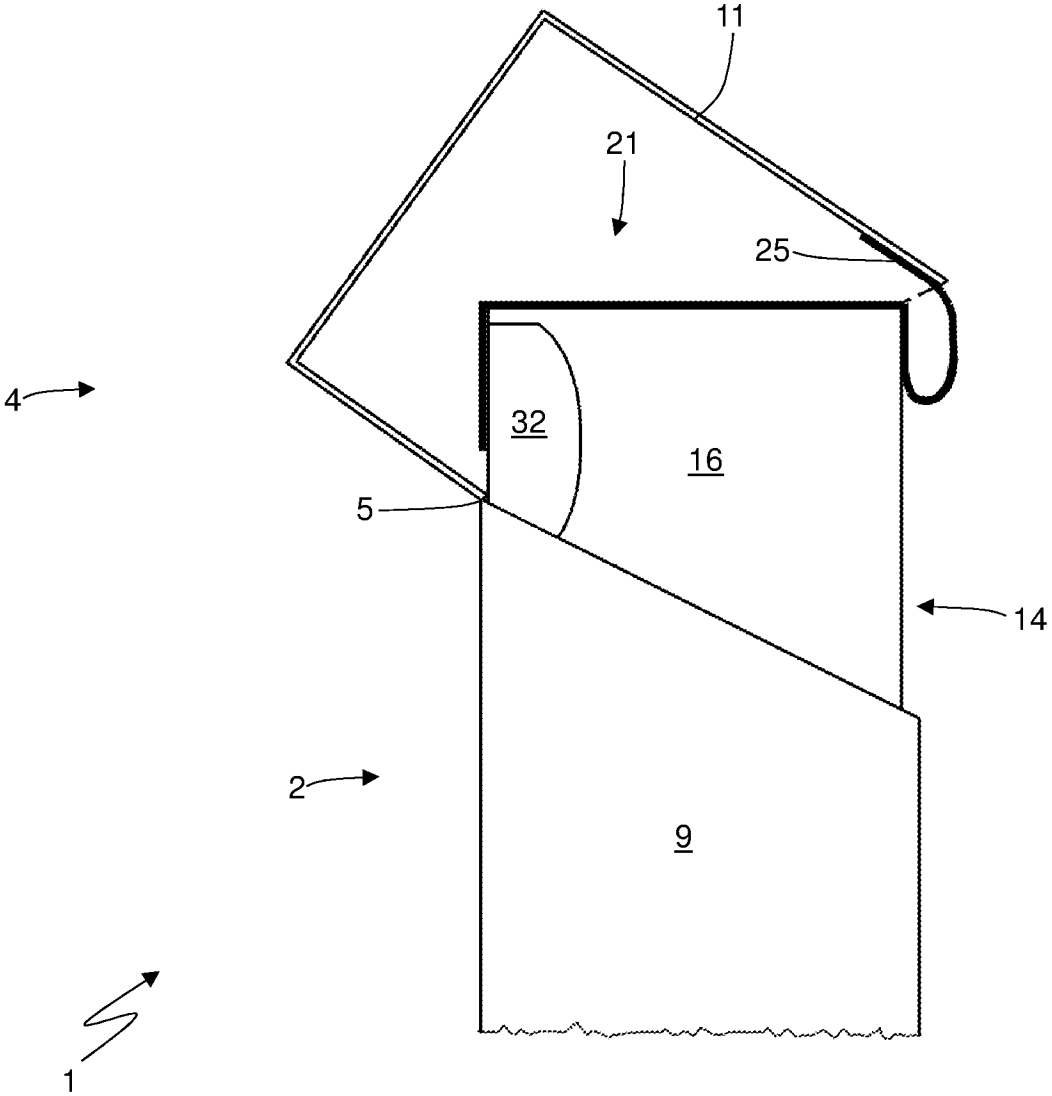
Figure 6:
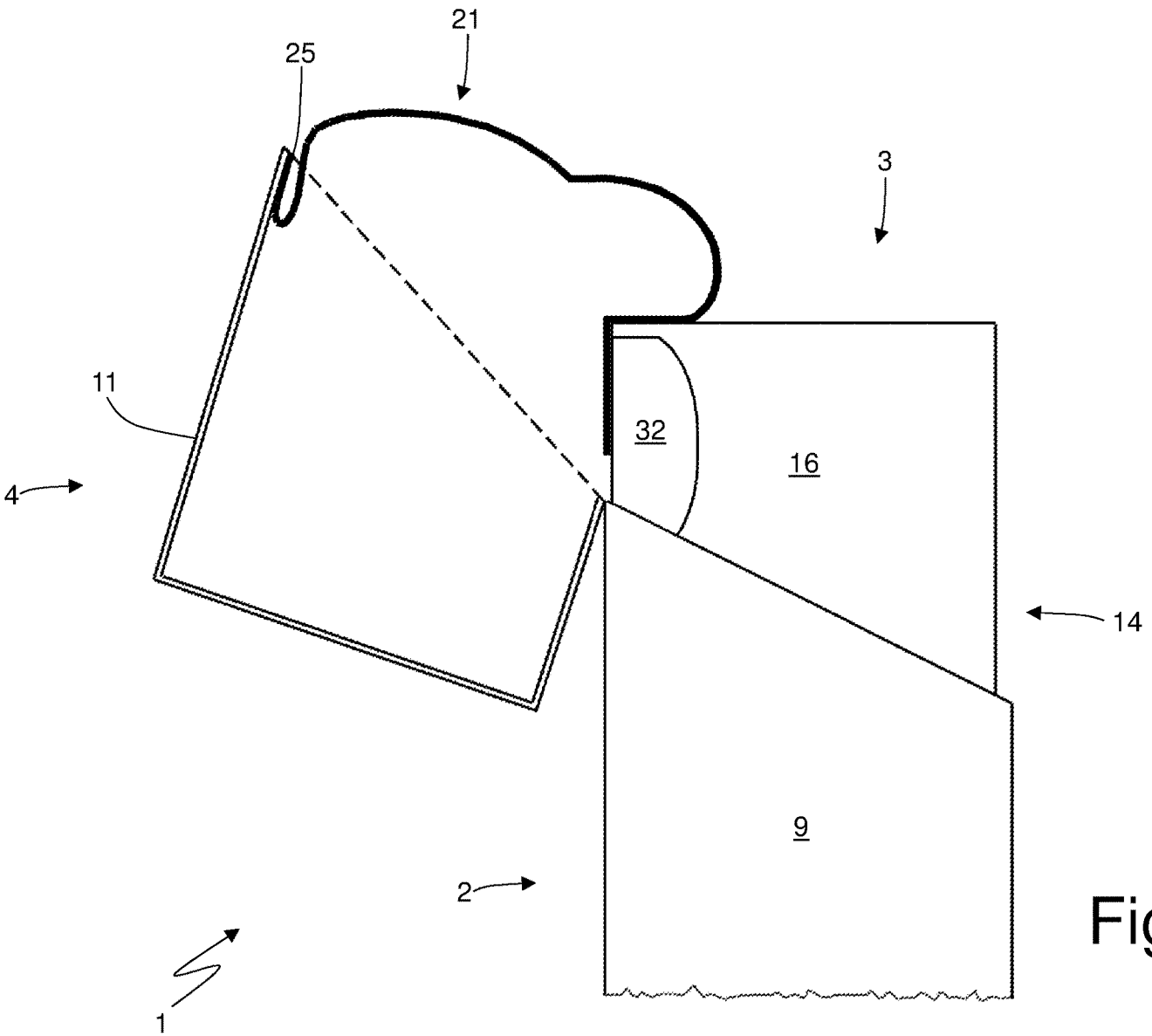

The sealing flap 21 is provided with a connecting tab 25, which is permanently and non-removably glued to the inner surface of the front wall 11 of the lid 4 by means of the permanent glue 26 (illustrated in FIG. 8) which is applied to the outer surface 27 of the sealing flap 21 (i.e. the surface of the sealing flap 21 facing outwards, that is, from the opposite wall of the collar 14). In this way, by opening or closing the lid 4 also the sealing flap 21 is simultaneously opened and closed, as is well illustrated in FIGS. 4, 5 and 6. According to a possible (but non-binding) embodiment, the connecting tab 25 is connected to the remaining part of the sealing flap 21 by means of a folding line 28 (schematically illustrated in FIG. 8) which has been preventively pre-weakened by means of the removal of material (for example by making a continuous incision involves only a part of the material, or by making several through incisions spaced apart one from the other to form a "dashed line" as better illustrated in FIGS. 11 and 12 of the patent application WO2012147073A1). It is important to note that the presence of the pre-weakened folding line 28 is useful as it improves the behaviour of the sealing flap 21 during the opening of the lid 4 and especially during the closure of the lid 4 (i.e. the folding flap 21 is subjected to lower mechanical stresses during the separation from the collar 14 and above all during the re-coupling to the collar 14 and therefore it re-couples more correctly to the collar 14); however, the presence of pre-weakened folding line 28 is not essential.

In the embodiment illustrated in the accompanying figures, the outer surface 27 of the connecting tab 25 of the sealing flap 21 is permanently and non-removably glued to the inner surface of the front wall 11 of the lid 4 by means of the permanent glue 26. According to a different and perfectly equivalent embodiment not illustrated, the connecting tab 25 of the sealing flap 21 is folded in a "U"-shape (i.e. it is folded by) 180° around the folding line 28 so that the inner surface 23 of the connecting tab 25 of the sealing flap 21 is permanently and non-removably glued to the inner surface of the front wall 11 of the lid 4 by means of the permanent glue 26; obviously in this case the permanent glue 26 is applied on the inner surface 23 of the connecting tab 25 of the sealing flap 21.

As illustrated in FIG. 8, the connecting tab 25 of the sealing flap 21 is provided only with the permanent glue 26 and is completely free from re-stick glue 24. According to a preferred embodiment illustrated in FIG. 8, the permanent glue 26 is arranged at a distance D1 different from zero from the folding line 28, i.e. the permanent glue 26 does not touch the folding line 28 and therefore there is an intermediate gap free from permanent glue 26 immediately next to the folding line 28. Similarly, according to a preferred embodiment illustrated in FIG. 14, the re-stick glue 24 is arranged at a distance D2 different from zero, from the folding line 28, i.e. the re-stick glue 24 does not touch the folding line 28 and therefore there is an intermediate gap free from re-stick glue 24 immediately next to the folding line 28. In this way, an area of the sealing flap 21 arranged astride the folding line 28 is completely free from glue on both sides (both from the re-stick glue 24 and from the permanent glue 26). From another point of view, there is a "free" area of the sealing flap 21 which is completely free from glue on both sides (both from the re-stick glue 24 and from the permanent glue 26) and is arranged between the area in which the re-stick glue 24 is provided and the area in which the permanent glue 26 is provided; in fact, the "free" area of the sealing flap 21 is also present when the sealing flap 21 is free from the pre-weakened folding line 28.

Figure 9:
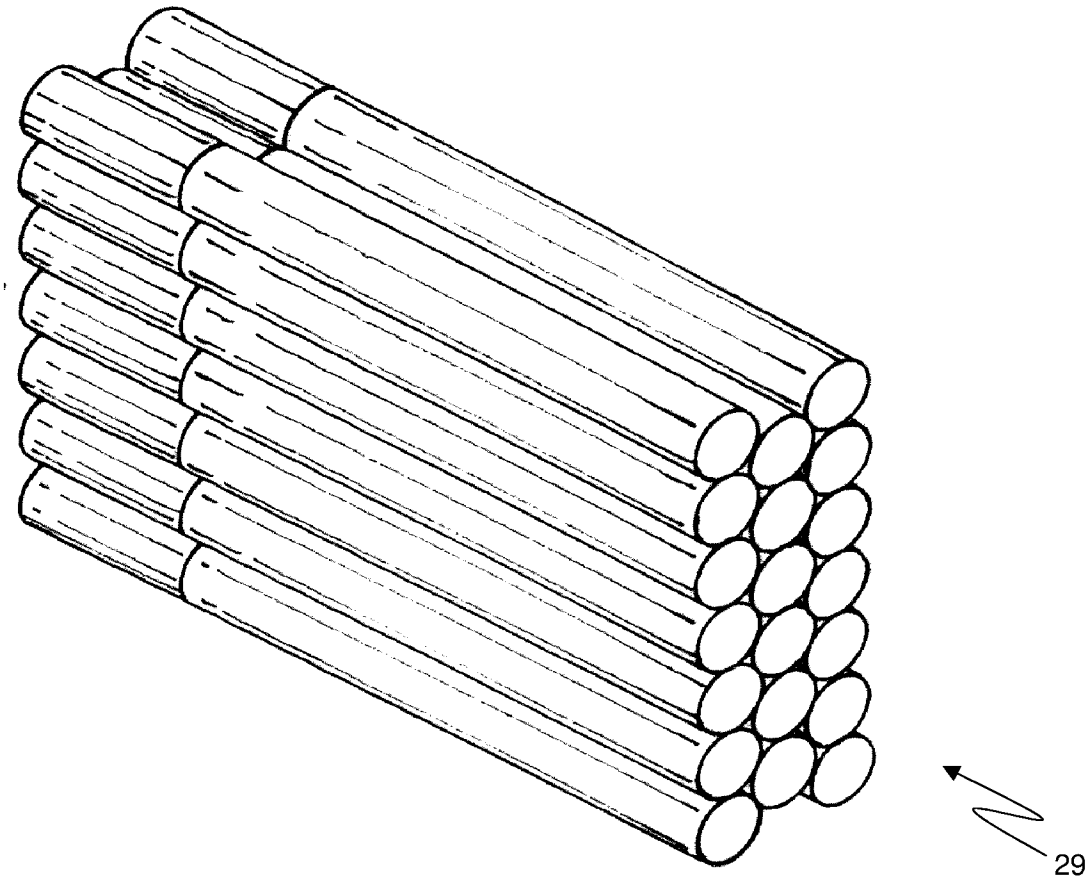
FIG. 9 is a front perspective view of a group of cigarettes contained in the cigarette package of FIG. 1.
Figure 10:
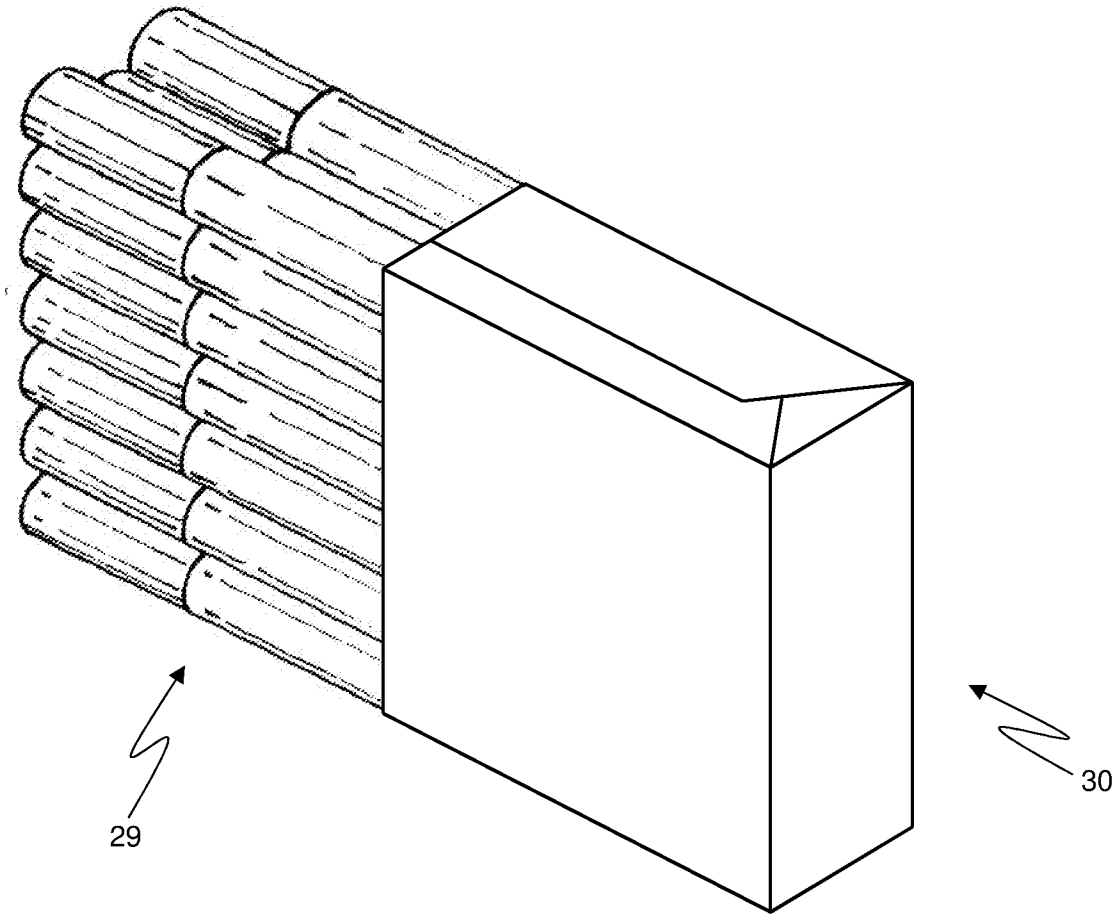
FIG. 10 is a perspective view of an inner wrap which partially encloses the group of cigarettes of FIG. 9.
Figure 11:
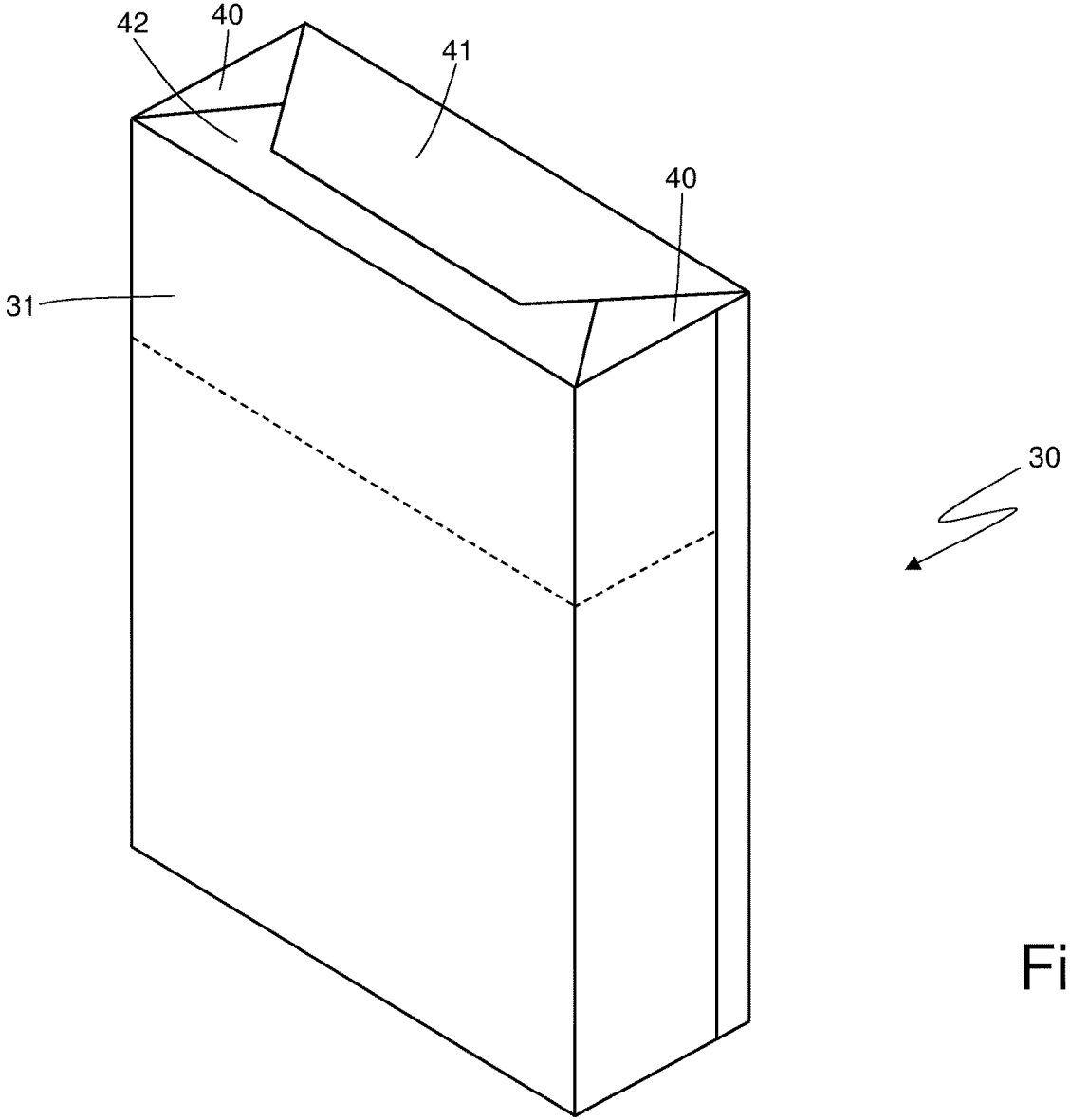
FIG. 11 is a perspective view of an inner wrap which completely encloses the group of cigarettes of FIG. 9.

As illustrated in FIG. 3, a group 29 of cigarettes is arranged inside the collar 14 (illustrated in its entirety in FIG. 9). According to a possible embodiment, the group 29 of cigarettes is free from an inner wrap and is in direct contact with the outer container 2 and with the collar 14; i.e. the group 29 of cigarettes is "naked" and is therefore completely free from an inner wrap which wraps the same and is inserted into the container 2 exactly as illustrated in FIG. 9. According to a different embodiment illustrated in FIG. 10, the group 29 of cigarettes is wrapped in an inner wrap 30, which is cup-shaped, leaves the upper part of the cigarettes completely visible (i.e. the filters of the cigarettes), and therefore is "invisible" from the outside of the container 2; in other words, the inner wrap 30 is shorter than the group 29 of cigarettes and therefore only covers a bottom portion of the group of cigarettes 29 itself, leaving a complementary top portion of the group 29 of cigarettes completely in sight (i.e. the inner wrap 30 is sized so as to wrap only a bottom portion of the group 29 of cigarettes opposite to the pull-out opening 20). In the embodiment illustrated in FIG. 10, the inner wrap 30 is not visible by the smoker using the cigarette package 1 and has the sole function of keeping the group 29 of cigarettes joined and cohesive during the manufacturing of the outer container 2. According to a further embodiment illustrated in FIG. 11, the group 29 of cigarettes is wrapped in an inner wrap 30 which completely covers the group 29 of cigarettes and is provided with a removable top portion (the so-called "pull") which must be removed when the cigarette package 1 is opened for the first time; in the embodiment illustrated in FIG. 11, the removable top portion 31 of the inner wrap 30 is manually removed by the smoker when the cigarette package 1 is opened for the first time whereas according to a different embodiment, not illustrated, the removable top portion 31 of the inner wrap 30 is glued (by means of permanent glue) to the sealing flap 21 to be opened and closed together with the sealing flap 21 itself. The inner wrap 30 which completely covers the group 29 of cigarettes could be made in a traditional way (i.e. only with folds free from glue as illustrated in FIG. 11) or it could be made more or less tight-sealed by means of heat-sealing.

According to a possible embodiment, the removable top portion of the inner wrap 30 is "T"-shaped, as illustrated for example in FIG. 1 of the patent application WO2014013468A1; the "T" shape of the removable top portion 31 of the inner wrap 30 enables to give to the removable top portion 31 the same shape and the same sizes of the pull-out opening 20 of the collar 14 thus making the removal of the removable top portion 31 particularly simple and fast.

According to a preferred embodiment, the inner wrap 30 (obviously only if present) is free from the reinforcing element made of cardboard or rigid paperboard and arranged inside the inner wrap 30 in contact with the group 29 of cigarettes. According to a different embodiment not illustrated, the inner wrap 30 (obviously only if present) could comprise a reinforcing element, which is made of cardboard or rigid paperboard (similar to the cardboard or rigid paperboard forming the outer container 2), is "U"-shaped and is arranged inside the inner wrap 30 in contact with the group 29 of cigarettes.

According to a preferred, but non-binding, embodiment illustrated in FIGS. 3-7, the collar 14 comprises a pair of fins 32, which are arranged on opposite sides of the collar 14 and rest against the respective side walls 16 of the collar 14. Each fin 32 is connected (hinged) to the rear wall 17 of the collar 14 and rests against the corresponding side wall 16; in other words, each fin 32 starts from the rear wall 17 of the collar 14 and rests against the corresponding side wall 16 projecting towards the front wall 15. In the preferred but non-binding embodiment illustrated in the accompanying figures, the fins 32 simply rest against and are not glued to the respective side walls 16 of the collar 14 (alternatively, the fins 32 could also be glued to the respective side walls 16 of the collar 14); preferably, but not necessarily, a bottom portion of each fin 32 is covered by the corresponding side wall 9 of the inner container 2 so that the side wall 9 of the inner container 2 holds the fin 32 adherent to the side wall 16 of the collar 14. The function of the fins 32 is to prevent the side walls 13 of the lid 4 from accidentally slipping under the side walls 16 of the collar 14 when the lid 4 is closed; in other words, the fins 32 cover from behind the side walls 16 of the collar 14 preventing the side walls 13 of the lid 4 from accidentally slipping under the side walls 16 of the collar 14. The presence of the fins 32 is useful but not essential, therefore an alternative embodiment of the cigarette package 1 does not provide for the presence of fins 32.

Figure 12:
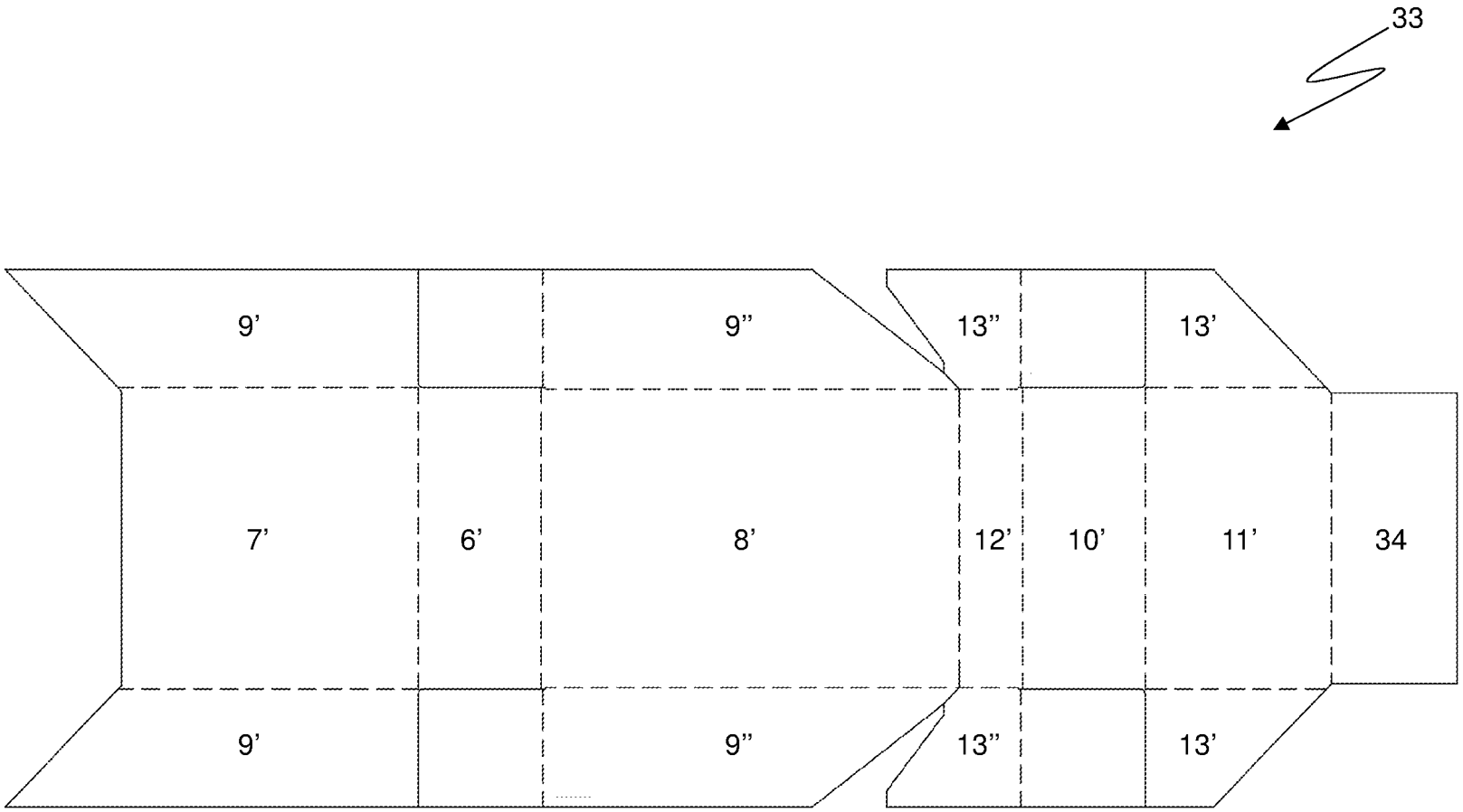
FIG. 12 is a plan view of a blank used to make a container and a lid of the cigarette package of FIG. 1.

According to what is illustrated in FIG. 12, the outer container 2 and the lid 4 are made by folding a conventional type blank 33. The blank 33 is provided with a reinforcing flap 34 which is glued inside the front wall 11 of the lid 4 (i.e. is glued to the panel 11' which forms the front wall 11 of the lid 4) and locally stiffens the front wall 11 itself; the connecting tab 25 of the sealing flap 21 is glued to the reinforcing flap 34 (which forms at least part of the inner surface of the front wall 11 of the lid 4) by means of the permanent glue 26.

Figure 13:
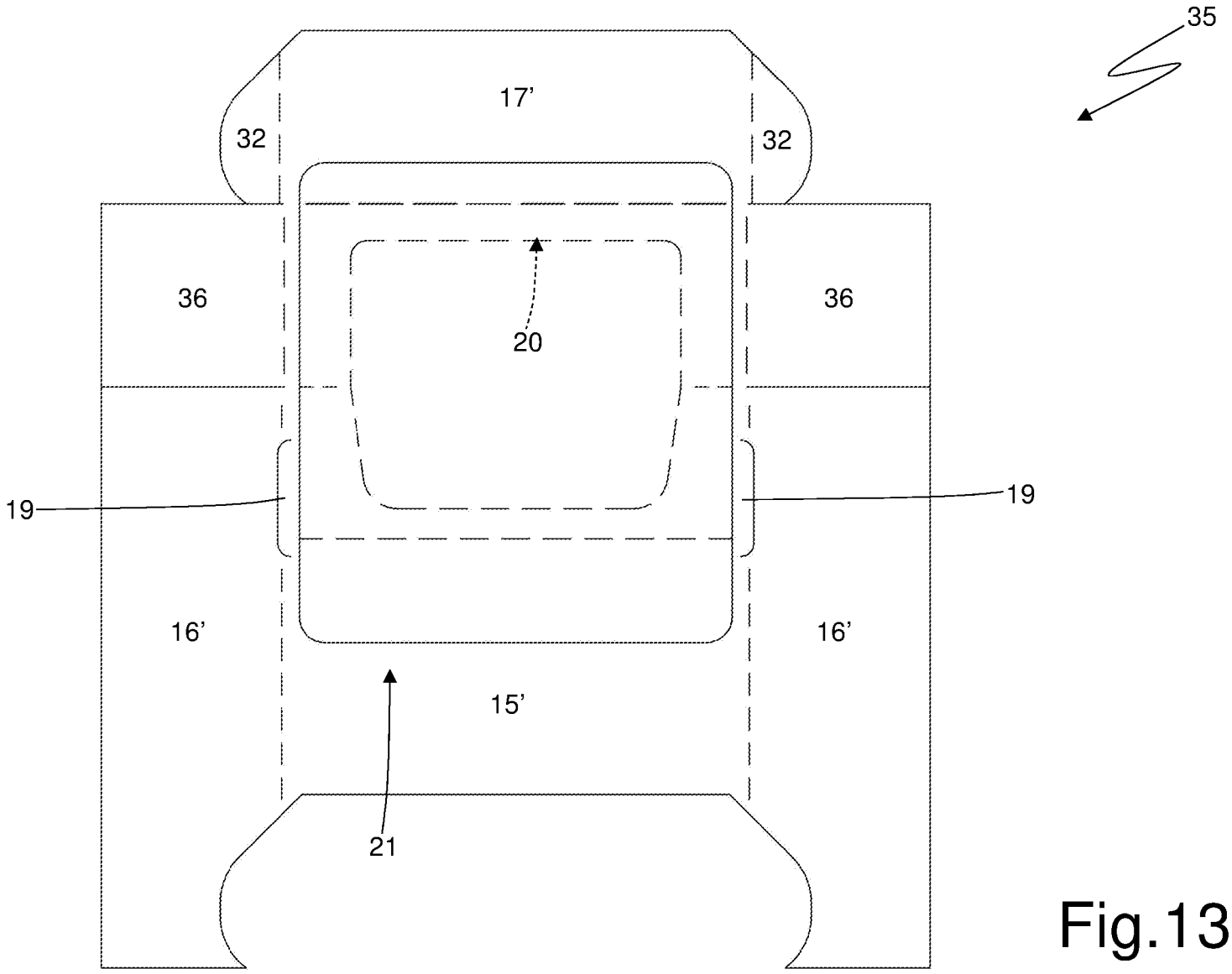
FIG. 13 is a plan view of a blank used to make the collar of FIG. 7.
Figure 14:
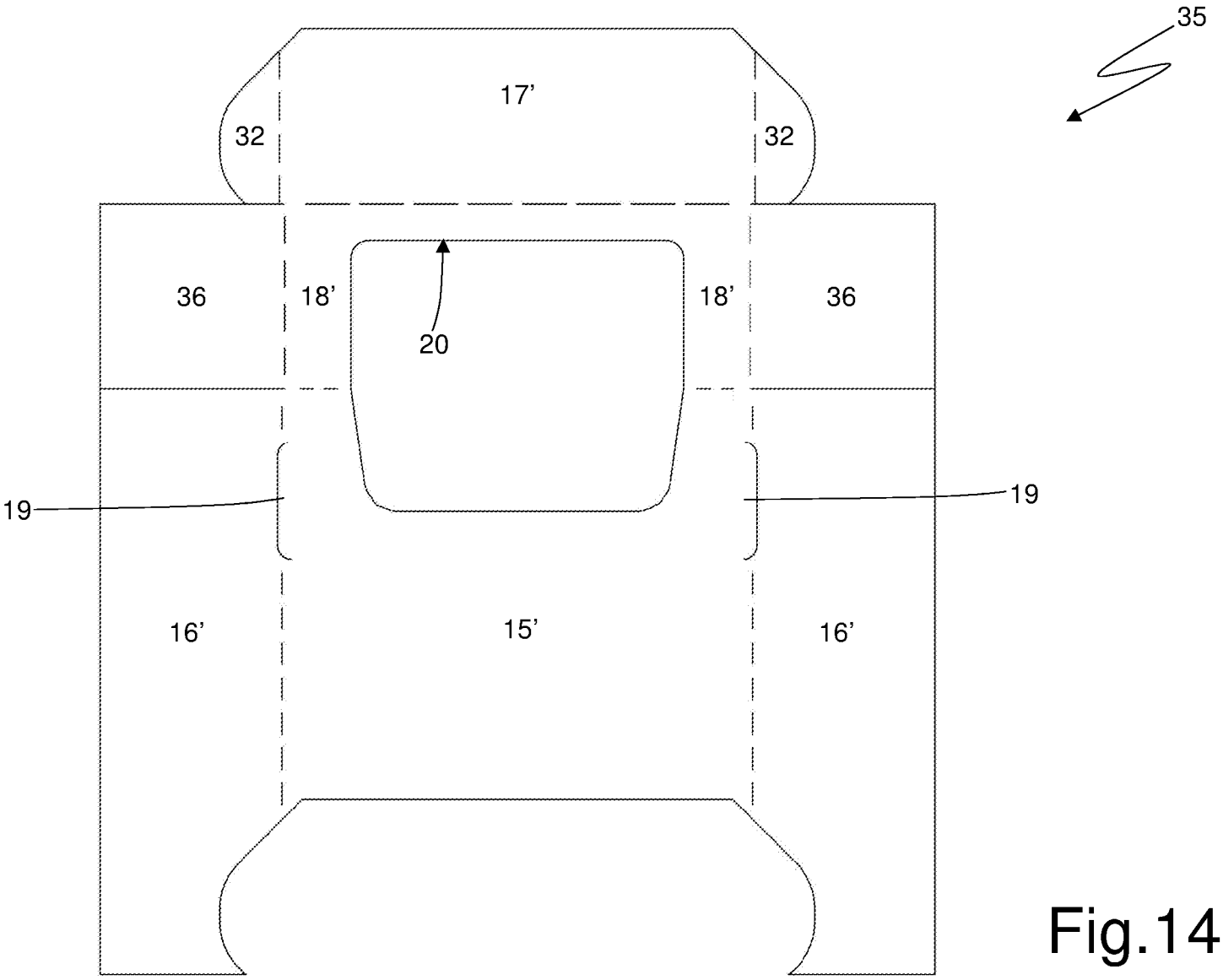
FIG. 14 is a plan view of the blank of FIG. 13 free from the adhesive sealing flap.

As illustrated in FIG. 13, the collar 14 is formed by folding a blank 35 to which the sealing flap 21 has previously been applied; in other words, initially the sealing flap 21 is applied to the flat blank 35 free from the sealing flap 21 (as illustrated in FIG. 14) which adheres to the blank 35 due to the action of the permanent glue 22 and of the re-stick glue 24. Then, around the group 29 of cigarettes (covered or not covered by the inner wrap 30) the blank 35, provided with the sealing flap 21, is folded. It is important to note that at the pull-out opening 20 for the collar 14, the sealing flap 21 must be free from the glue re-stick 24 both to prevent, during storage, handling and folding of the blank 35, that the sealing flap 21 can be glued to another blank 35 or to parts of the packaging machine, both to avoid that the sealing flap 21 can be glued to the underlying ends of the cigarette when the cigarette package 1 is completed. This result can be obtained by avoiding to deposit the re-stick glue 24 at the pull-out opening 20 of the collar 14, or by neutralizing the re-stick glue 24 present at the pull-out opening 20 of the collar 14.

The blank 35 comprises two tabs 36, which are arranged on opposite sides of the top wall 18 of the collar (i.e. are arranged on opposite sides of the panel 18' which forms the top wall 18 of the collar 14), are connected to the top wall 18 of the collar along respective pre-weakened folding lines, are folded by 90° relative to the top wall 18 of the collar, and rest on the inside against the respective side walls 16 of the collar 14.

According to a preferred, but non-binding, embodiment illustrated in the accompanying figures, the collar 14 is free, on the inside, from glue (i.e. no glue is used to connect one to the other parts of the collar 14) and the collar 14 is only glued to the walls 7, 8 and 9 of the outer container 2; i.e. the front wall 15 of the collar 14 is glued to the front wall 7 of the outer container 2, the side walls 16 of the collar 14 are glued to the side walls 9 of the outer container 2, and the rear wall 17 of the collar 14 is glued to the rear wall 8 of the outer container 2 (alternatively the rear wall 17 of the collar 14 can also not be glued to the rear wall 8 of the outer container 2).

In the embodiments illustrated in the accompanying figures, the connecting tab 25 of the sealing flap 21 is permanently and non-removably glued to the inner surface of the front wall 11 of the lid 4 by means of the permanent glue 26 so that the movement of the lid 4 also determines the movement of the closing tab 16. According to a different embodiment not illustrated (which is not part of the present invention), the connecting tab 25 of the sealing flap 21 is not glued to the lid 4 and therefore the movement of the lid 4 is completely independent from the movement of the sealing flap 21; in this embodiment, the user grasps the connecting tab 25 (which in this embodiment effectively becomes a gripping tab) with the fingers for lifting or lowering the sealing flap 21.

Figure 16:
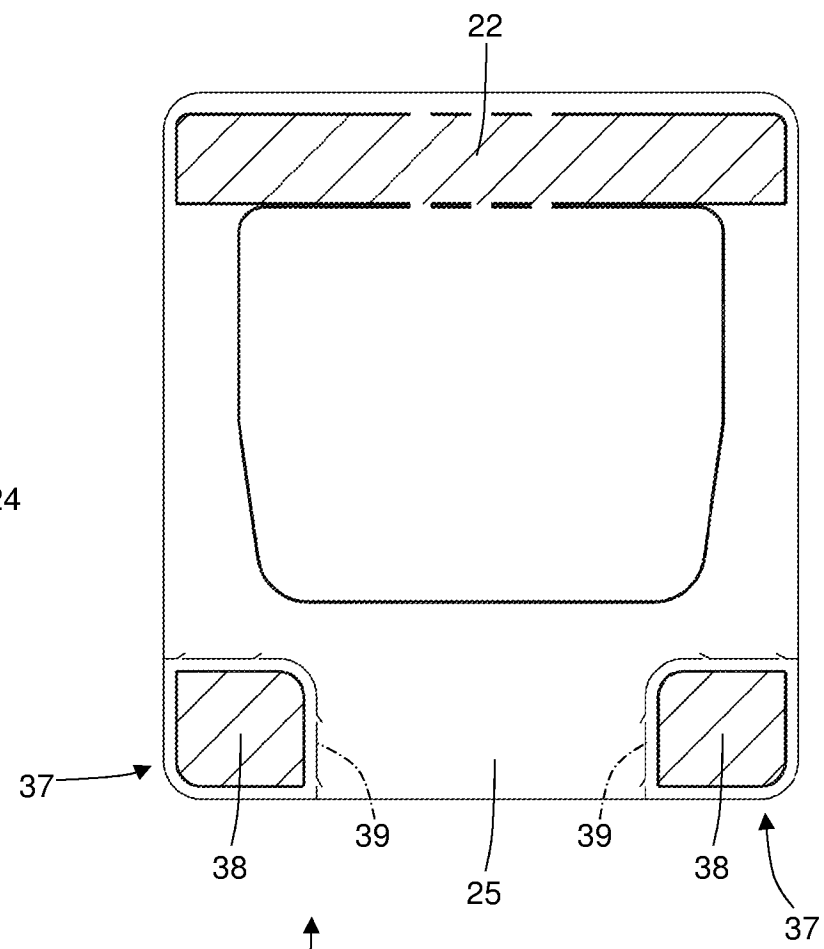
FIGS. 15 and 16 are two plan views of alternatives of the adhesive sealing flap of FIG. 8.
Figure 15:
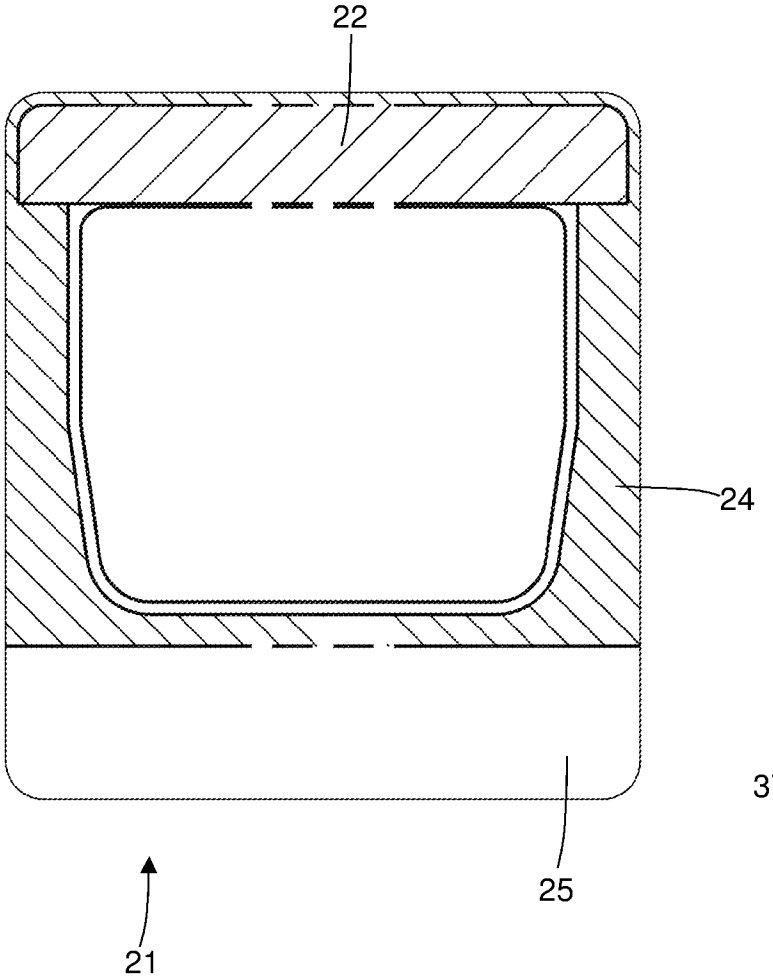
Figure 18:
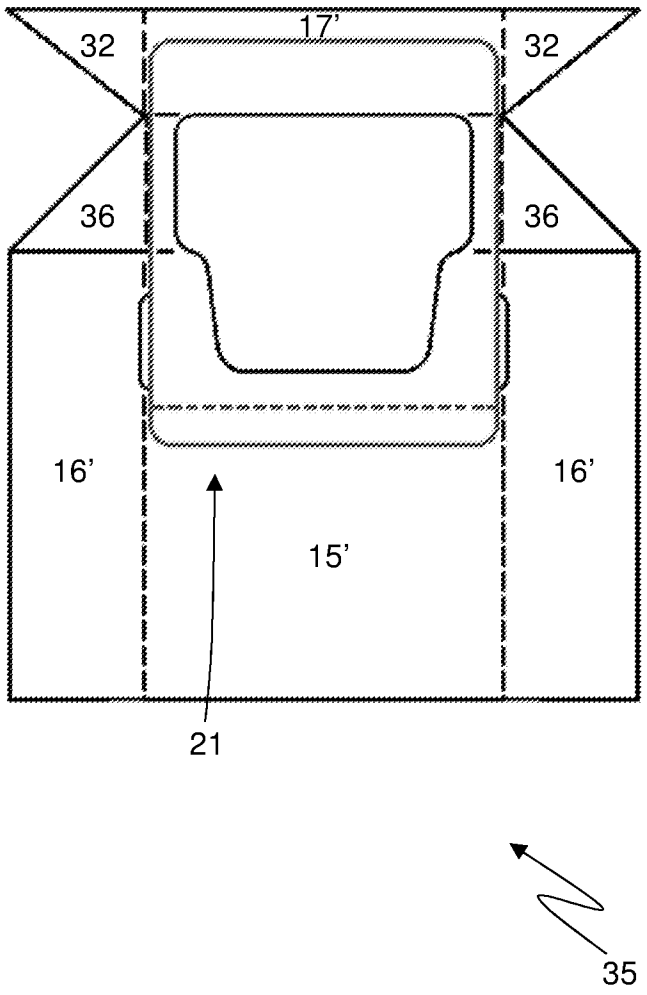
FIGS. 17-21 are plan views of respective different embodiments of the blank of FIG. 13.
Figure 17:
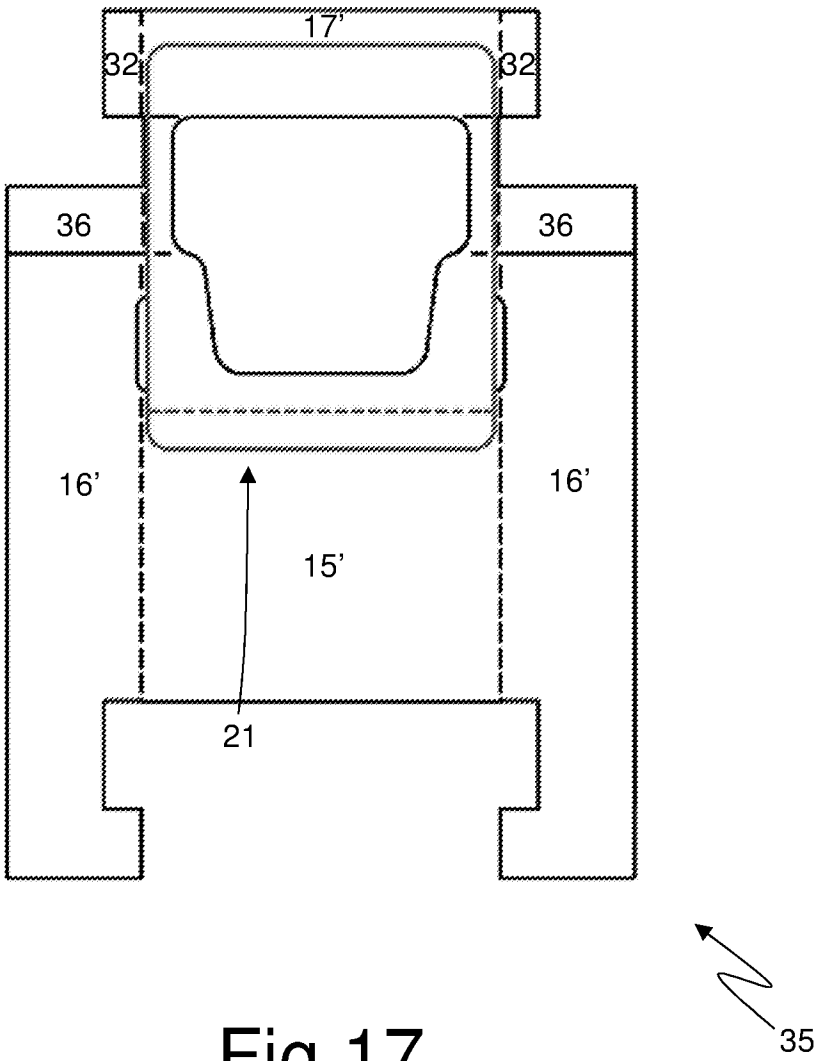
Figure 20:
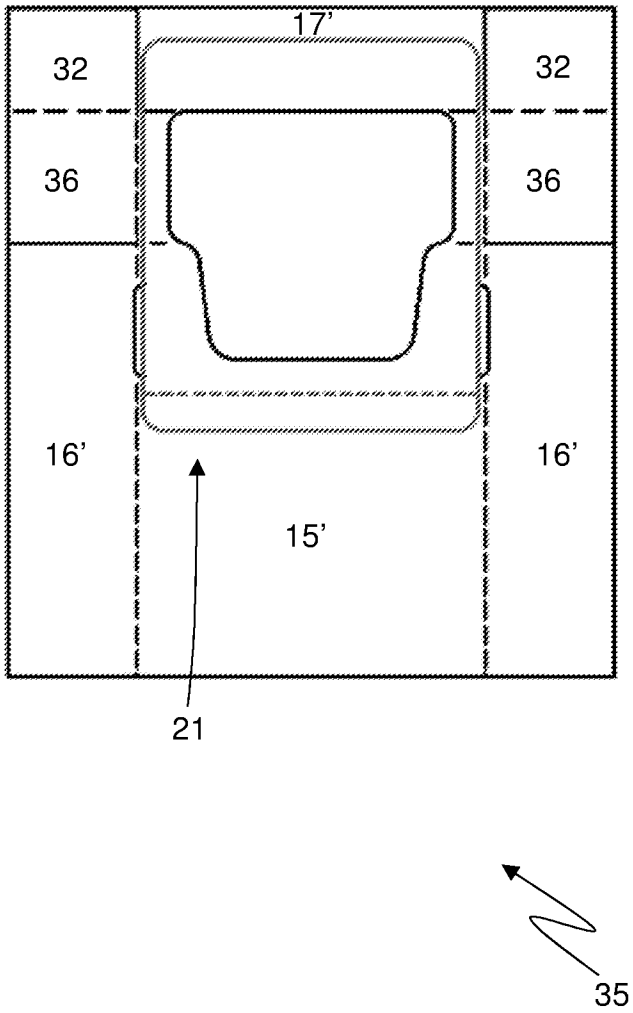
Figure 19:
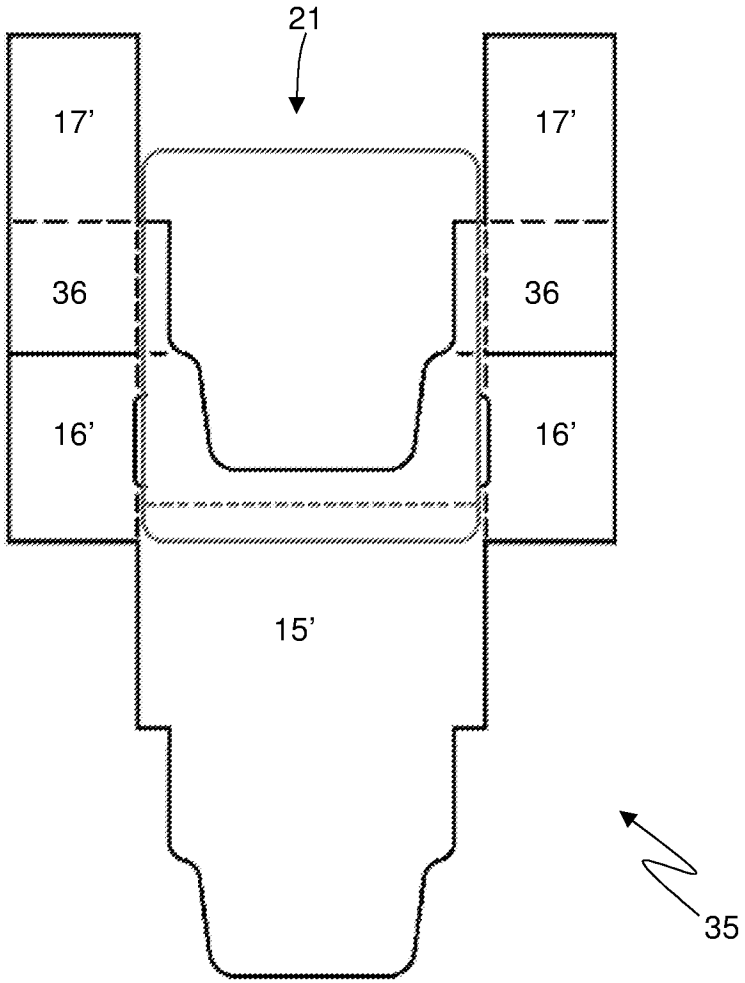

In the embodiments illustrated in FIGS. 1-15, the sealing flap 21 is provided with the re-stick glue 24. In the alternative embodiment illustrated in FIG. 16, the sealing flap 21 is free from the re-stick glue 24. When the sealing flap 21 is free from the re-stick glue 24, preferably (but not necessarily), two front portions 37 of the sealing flap 21 are permanently connected to the front wall 15 of the collar 14 by means of a strong permanent glue 38 and are connected to the remainder part of the sealing flap 21 along respective pre-weakened folding lines 39: the first time the lid 4 is opened, i.e. the first time the sealing flap 21 is lifted, the pre-weakened, folding lines 39 are torn away leaving the two front portions 37 of the sealing flap 21 glued to the front wall 15 of the collar 14. The function of the two front portions 37 of the sealing flap 21 is to keep the sealing flap 21 in close contact with the blank 35 (from which the collar 14 is obtained) during the manufacturing of the cigarette package 1 preventing the sealing flap 21 from "flapping" when the blank 35 is transferred and handled and impacts against the mechanical structures of the processing path of the packaging machine, thus crumpling-up. This embodiment which involves the tearing of the two front portions 37 of the sealing flap 21 along the pre-weakened folding lines 39 provides an evident and unequivocal proof of first opening and is therefore a "tamperproof" package, i.e. a package that cannot be opened without any trace evidence of its opening. The presence of the two front portions 37 of the sealing flap 21 permanently connected to the front wall 15 of the collar 14 by means of the strong permanent glue 38 and connected to the remaining part of the sealing flap 21 along respective pre-weakened folding lines 39 could also be combined with the presence of the re-stick glue 24 between the sealing flap 21 and the collar 14 to also provide in this embodiment the proof of the first opening. According to an alternative embodiment, the strong permanent glue 38 could be replaced by a weak glue (permanent or re-stick) which easily separates from the front wall 15 of the collar 14 the first time the lid 4 is opened, i.e. the first time the sealing flap 21 is lifted; in this case the pre-weakened folding lines 39 are not present, as to separate the sealing flap 21 from the front wall 15 of the collar 14, it is not necessary to tear-off the sealing flap 21 since the glue connecting the sealing flap 21 to the front wall 15 of the collar 14 at the two front portions 37 is weak (this weak glue opposes a soft resistance to tearing and therefore the first time the lid 4 is opened, i.e. the first time the sealing flap 21 is lifted, the front portions 37 of the sealing flap 21 separate from the front wall 15 of the collar 14).

In the embodiments illustrated in the accompanying figures, the collar 14 has both the rear wall 17 and the top wall 18. According to various embodiments not illustrated, the collar is free from the rear wall 17 (and has the top wall 18) or is free from the top wall 18 (and has the rear wall 17); i.e. the presence of at least one between the rear wall 17 and the top wall 18 is necessary to permanently glue the sealing flap 21 by means of the permanent glue 22 and/or by means of the re-stick glue 24, but it is not strictly necessary that both walls 17 and 18 are present.

In the embodiments illustrated in the accompanying figures, the collar 14 is free from lower (bottom) wall. According to a different embodiment not illustrated, the collar 14 also comprises a lower (bottom) wall; obviously in this embodiment at least the walls 15 and 16 of the collar are "full-height" (i.e. they have the same extension of the corresponding walls 7 and 9 of the outer container 2) and the collar 14 becomes a real inner container arranged inside to the outer container 2. FIGS. 17-21 illustrate respective alternatives of the blank 35 used to form the collar 14; these alternatives respond to aesthetic requirements (i.e. to give a particular outward appearance to the cigarette package 1 containing the collar 14) and/or to machining requirements (i.e. to be able to obtain all the folds foreseen in an existing packaging machine without having to radically change the packaging machine itself).

Figure 21:
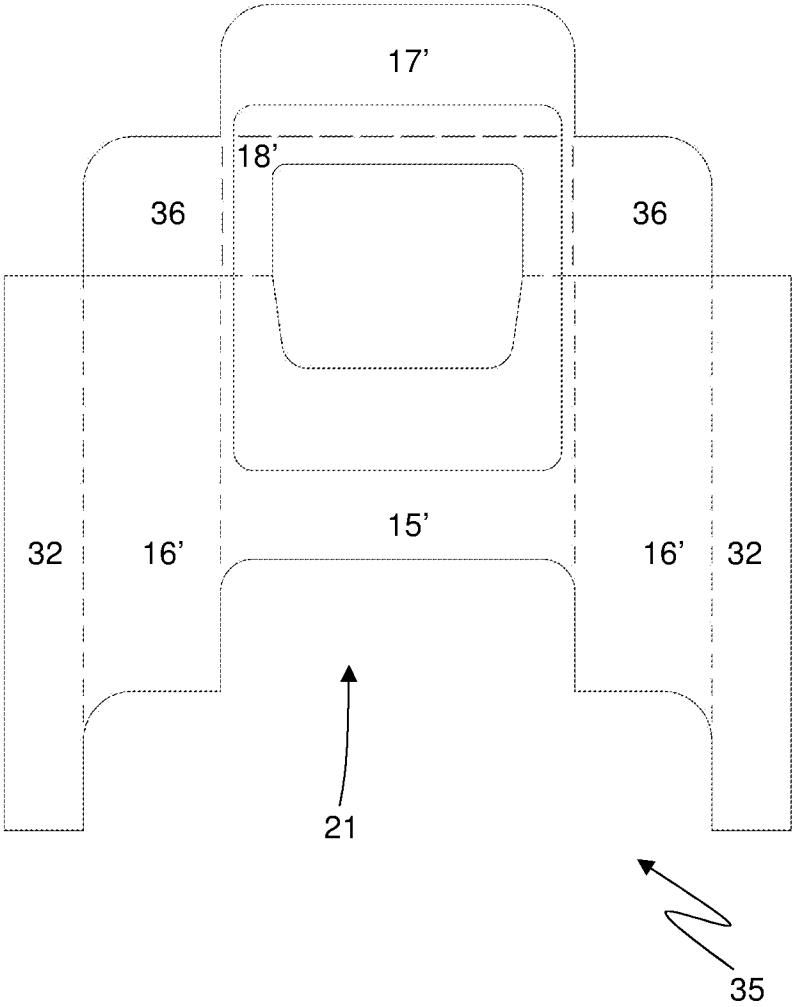

In the embodiment illustrated in FIG. 21, the two fins 32 (which have a significant size) are not connected, that is, hinged, to the rear wall 17 of the collar 14, but are instead connected, i.e. hinged, to the corresponding side walls 16 of the collar 14).

As illustrated in FIG. 11, the inner wrap 30 which encloses the group 2 of cigarettes is made by folding a rectangular wrapping sheet (not illustrated flat) to initially form a tube having two open ends at the top wall and at the bottom wall and then to close each tubular open end according to the traditional "soap fold", i.e. by initially making two side tabs 40 (smaller) in the top wall (as well as in the bottom wall) and then making two central and tabs 41 and 42 (larger) with a trapezoidal shape, which overlap one another and are placed on the side tabs 40. As illustrated in FIG. 11, the rear central tab 41 (i.e. originating from the rear edge) overlaps the front central tab 42 (i.e. originating from the front edge); this embodiment is preferable when the rear central tab 41 is glued to the sealing flap 21 and therefore lifts or lowers together with the sealing flap 21 completely freeing, when the lid 4 is open, the front central tab 42 which is part of the tear-off disposable top portion of the inner wrap 30. According to an alternative embodiment not illustrated, the front central tab 42 overlaps the rear central tab 41; this embodiment is preferable when the rear central tab 41 is not glued to the sealing flap 21, since the front central tab 42 must be easily grasped by the smoker being part of the tear-off disposable top portion of the inner wrap 30.

According to a possible embodiment, the inner wrap 30 can be flavoured (preferably, with menthol); in other words, the wrapping sheet which forms the inner wrap 30 is previously impregnated with aromatic substances (preferably, but not necessarily, with menthol). Alternatively, the flavouring substances could be applied to the collar 14 or the outer container 2 instead of the inner wrap 30.

In the embodiments illustrated in the accompanying figures, the longitudinal and transverse edges are straight; alternatively, the longitudinal and/or transverse edges could be rounded or bevelled.

In the embodiments illustrated in the attached figures, the cigarette package 1 contains a group 29 of cigarettes; alternatively, the cigarette package 1 can contain any other type of smoking items such as cigars, electric or electronic cigarettes (i.e. cigarettes that generate an aerosol without combustion), cartridges and refills for electronic cigarettes, new generation cigarettes.

The cigarette package described above has numerous advantages.

Firstly, in the cigarette package 1 described above, the lid 4 always remains in a stable manner in the completely closed position due to the presence of the collar 14 which projects from the open top end 3 of the outer container 2.

Moreover, in the cigarette package described above, the use of wrapping material is minimized, since although presenting the sealing flap 21 does not require the presence of the inner wrap 30, nor the presence (when the inner wrap 30 is provided) of a reinforcing element in cardboard or rigid paperboard placed inside the inner wrap 30 in contact with the group 29 of cigarettes.

In the cigarette package 1 described above there is no risk of interference between the sealing flap 21 and the collar 14, since the sealing flap 21 is arranged on the outside of the collar 14.

Finally, the cigarette package 1 described above can be made in a standard packaging machine for rigid cigarette packages with a hinged lid with very few modifications concentrating essentially in the folding stations of the blank 35 which forms the collar 14 and in the feeding unit of the blank 35 which forms the collar 14. Thus, the cigarette package 1 described above does not require the use of an expensive special packaging machine (that is, specially designed for this type of cigarette packages) for its production.

The invention claimed is:

1. A package (1) for smoking articles comprising:

a group (29) of smoking articles;

an outer container (2), which is cup-shaped, houses the group (29) of smoking articles and has: an open top end (3), a bottom wall (6) opposite to the open top end (3), a front wall (7) and a rear wall (8), which are parallel and opposite to one another, and two side walls (9), which are parallel and opposite to one another;

a lid (4), which is cup-shaped, is hinged to the outer container (2) so as to rotate, relative to the outer container (2), between an open position and a closed position of the open top end (3), and has: an open bottom end, a top wall (10), a front wall (11) and a rear wall (12), which are parallel and opposite to one another, and two side walls (13), which are parallel and opposite to one another;

a collar (14), which is glued on the inside of the outer container (2) so as to partially project outwards from the open top end (3), comprises a front wall (15), two side walls (16), a rear wall (17) and a top wall (18), and has a through pull-out opening (20), through which the smoking articles can be pulled out; and a sealing flap (21), which is arranged on the outside of the collar (14) and is glued to the collar (14) at least one of the rear wall (17) of the collar and the top wall (18) of the collar and, when the lid (4) is in the closed position, covers the pull-out opening (20);

wherein the sealing flap (21) comprises a connecting tab (25), which is permanently and non-removably glued to the front wall (11) of the lid (4) by means of a first permanent glue (26), so that, the opening and closing of the lid (4) also simultaneously opens and closes the sealing flap (21);

wherein the top wall (18) of the collar (14) is U-shaped and surrounds the pull-out opening (20) by means of two side sections and a rear section;

wherein a second permanent glue (22) is applied to an inner surface (23) of the sealing flap (21), and is placed between the sealing flap (21) and the collar (14), so as to permanently glue the sealing flap (21) to the collar (14); and wherein the second permanent glue (22) is placed partly at the rear wall (17) of the collar (14) and partly at the rear section of the top wall (18) of the collar (14).

2. The package (1) for smoking articles according to claim 1, wherein: the second permanent glue (22) is placed only on a rear section of the top wall (18) of the collar (14).

3. The package (1) for smoking articles according to claim 1 and comprising a re-stick glue (24), which is placed between the sealing flap (21) and the collar (14), so as to removably glue the sealing flap (21) to the collar (14), and is not present at the pull-out opening (20).

4. The package (1) for smoking articles according to claim 1, wherein:

the sealing flap (21) is free from re-stick glue (24); and two front portions (37) of the sealing flap (21) are steadily connected to the front wall (15) of the collar (14) by means of a strong permanent glue (38) and are connected to the remaining part of the sealing flap (21) along respective pre-weakened tear-open lines (39).

5. The package (1) for smoking articles according to claim 1, wherein:

the sealing flap (21) is free from re-stick glue (24); and two front portions (37) of the sealing flap (21) are connected to the front wall (15) of the collar (14) by means of a weak glue.

6. The package (1) for smoking articles according to claim 1, wherein:

the collar (14) comprises a pair of fins (32), which are arranged on opposite sides of the collar (14), are connected to the rear wall (17) of the collar (14), and rest against the respective side walls (16) of the collar (14);

the pair of fins (32) simply rest against and are not glued to the respective side walls (16) of the collar (14); and a bottom portion of each fin (32) is covered by a corresponding one of the two side walls (9) of the outer container (2) so that the corresponding one of the two side walls (9) of the outer container (2) holds the fin (32) adherent to the side wall (16) of the collar (14).

7. The package (1) for smoking articles according to claim 1, wherein the group (29) of smoking articles is free from an inner wrap and is in direct contact with the outer container (2) and with the collar (14).

8. The package (1) for smoking articles according to claim 1, wherein the group (29) of smoking articles is wrapped in an inner wrap (30) which is cup-shaped and is sized so as to wrap only a portion of the group (29) of smoking articles opposite to the pull-out opening (20).

9. The package (1) for smoking articles according to claim 1, wherein the group (29) of smoking articles is wrapped in an inner wrap (30) which completely covers the group (29) of smoking articles and is provided with a removable top portion (31), which must be removed when the package (1) is opened for the first time.

10. The package (1) for smoking articles according to claim 9, wherein:

a top end of the inner wrap (30) has two smaller side tabs (40) and two central tabs (41, 42) with a trapezoidal shape, which overlap one another and are placed on the smaller side tabs (40); and the removable top portion (31) is manually removed by the smoker when the package (1) is opened for the first time and comprises a front central tab (42); and a rear central tab (41) that overlaps on the front central tab (42) and is glued to the sealing flap (21).

11. A method for manufacturing a package (1) for smoking articles according to claim 1; the manufacturing method comprising:

providing a flat blank (35) used to obtain the collar (14) and having the pull-out opening (20) formed therein;

applying the sealing flap (21) to the flat blank (35) at the previously formed pull-out opening (20); and folding the flat blank (35) provided with the sealing flap (21) around the group (29) of smoking articles.

* * * * *